US006871934B2

(12) United States Patent
Masuyama et al.

(10) Patent No.: US 6,871,934 B2
(45) Date of Patent: Mar. 29, 2005

(54) INK JET PRINT HEAD AND INK JET PRINTING APPARATUS

(75) Inventors: Atsuhiko Masuyama, Kanagawa (JP); Hiroshi Tajika, Kanagawa (JP); Yuji Konno, Kanagawa (JP); Daisaku Ide, Tokyo (JP); Norihiro Kawatoko, Kanagawa (JP); Takayuki Ogasahara, New York, NY (US); Tetsuya Edamura, Kanatawa (JP); Akiko Maru, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 3 days.

(21) Appl. No.: 10/395,160

(22) Filed: Mar. 25, 2003

(65) Prior Publication Data

US 2003/0184608 A1 Oct. 2, 2003

(30) Foreign Application Priority Data

Mar. 28, 2002 (JP) ..... 2002-093019

(51) Int. Cl.[7] ..... B41J 2/165
(52) U.S. Cl. ..... 347/23
(58) Field of Search ..... 347/14, 23, 24, 347/29, 35

(56) References Cited

U.S. PATENT DOCUMENTS

| | | | | |
|---|---|---|---|---|
| 4,313,124 A | | 1/1982 | Hara | 346/140 R |
| 4,345,262 A | | 8/1982 | Shirato et al. | 346/140 R |
| 4,459,600 A | | 7/1984 | Sato et al. | 346/140 R |
| 4,463,359 A | | 7/1984 | Ayata et al. | 346/1.1 |
| 4,558,333 A | | 12/1985 | Sugitani et al. | 346/140 R |
| 4,608,577 A | | 8/1986 | Hori | 346/140 R |
| 4,723,129 A | | 2/1988 | Endo et al. | 346/1.1 |
| 4,740,796 A | | 4/1988 | Endo et al. | 346/1.1 |
| 6,227,641 B1 | | 5/2001 | Nishikori et al. | 347/17 |
| 6,267,476 B1 | | 7/2001 | Kato et al. | 347/100 |
| 6,631,976 B2 | * | 10/2003 | Hamamoto et al. | 347/35 |
| 2002/0167565 A1 | | 11/2002 | Maeda et al. | 347/40 |

FOREIGN PATENT DOCUMENTS

| | | |
|---|---|---|
| JP | 54-056847 A | 5/1979 |
| JP | 59-123670 A | 7/1984 |
| JP | 59-138461 A | 8/1984 |
| JP | 60-071260 A | 4/1985 |
| JP | 8-336962 A | 12/1996 |
| JP | 10-016228 A | 1/1998 |

* cited by examiner

*Primary Examiner*—Shih-Wen Hsieh
(74) *Attorney, Agent, or Firm*—Fitzpatrick, Cella, Harper & Scinto

(57) ABSTRACT

After the front end area of the print medium has been printed and when the printing is to be continued following the front end area, a preliminary ejection is performed, prior to the current scan, on the nozzles that have not been used in preceding scans but begin to be used in a current scan, in order to remove viscous ink from the nozzles and making them ready to perform ejection. As a result, the ink ejection from the nozzles that begin to be used in the current scan becomes satisfactory.

20 Claims, 9 Drawing Sheets

| | NOZZLE NO. IN USE | ×-MARKED NOZZLE NO. |
|---|---|---|
| 1 | 1-32 | 1-32 |
| 2 | 1-64 | 33-64 |
| 3 | 1-96 | 65-96 |
| 4 | 1-128 | 97-128 |
| 5 | 1-128 | NO |
| ⋮ | ⋮ | ⋮ |
| N | 1-128 | NO |
| N+1 | 1-224 | 129-224 |
| N+2 | 1-320 | 225-320 |
| N+3 | 1-416 | 321-416 |
| N+4 | 1-512 | 417-512 |
| N+5 | 1-512 | NO |
| ⋮ | ⋮ | ⋮ |

×PRELIMINARY EJECTION IS DONE ON ONLY X-MARKED NOZZLES AT HEAD OF CURRENT LINE

×PRELIMINARY EJECTION IS DONE ON ONLY X-MARKED NOZZLES AT HEAD OF CURRENT LINE

FIG.6

INK JET PRINT HEAD AND INK JET PRINTING APPARATUS

This application claims priority from Japanese Patent Application No. 2002-093019 filed Mar. 28, 2002, which is incorporated hereinto by reference.

BACKGROUND OF THE INVENTION

1. Field of the Invention

The present invention relates to an ink jet printing apparatus and an ink jet printing method, and more particularly to an ink jet printing apparatus which performs a marginless printing. In the concrete, a marginless printing is printing an image on a print medium without leaving a blank margin at least one end (edge) portion of the print medium. Further, the present invention relates to an ink jet printing method which controls the number of nozzles used for the marginless printing at an edge portion of the print medium where there is a large transport error.

2. Description of the Related Art

In a serial type ink jet printing apparatus which prints an image on a print medium by repeating a printing scan of a print head and a line feed (or paper feed) alternately, it is difficult to print on a front or rear end portion of the print medium because of the print head scan and line feed. In recent years, however, the printing on the front or rear end portion of a print medium has become possible by using only a part of the nozzles arrayed in the print head for printing and by repeating a small line feed and a small-width printing scan. Printing apparatus capable of such a marginless printing have been available.

In the marginless printing (or margin-free printing), an ink absorber with its width corresponding to a length of a nozzle column in the print head is provided to a platen rib to absorb ink that is ejected outside a print medium due to print medium transport and cutting errors, thus preventing an interior of the apparatus or a back side of the print medium from being contaminated or smeared.

As shown in FIG. 9, a front end area of a print medium is printed by repetitively alternating a printing scan using four nozzles, counting from the end of the nozzle column, and a small line feed of about one nozzle. Repeating this printing scan followed by the small line feed several times completes the printing on the front end area of the print medium. After this, the number of nozzles used for printing is increased according to the line feed distance. In this example, the number of nozzles used for printing is increased by three nozzles at a time (added nozzles are marked with X in the figure).

However, in this marginless printing that uses only a part of the nozzles in the nozzle column, the ink state in those nozzles being used and the ink state in the remaining nozzles not used greatly differ. Particularly, in a bubble-through type ink jet printing apparatus which applies heat to ink in the nozzles by heaters to generate bubbles in the ink and thereby expel ink droplets, the ink state in the nozzles has great effects on the ink ejection.

In the example case of FIG. 9, the ink in the four nozzles that have been used from the beginning is kept hot and low-viscous and thus their ejection state is stable. As to the nozzles that were brought into operation from the middle of the printing process (nozzles marked with X in the figure), because they were put out of operation, the ink in these nozzles is cold and somewhat dry and their ejection is unstable. Therefore, the nozzles that began to be used from the middle of the printing process cannot produce a good printed result and may degrade a quality of that portion of an image printed by these nozzles (in the figure, a printed portion S).

In addition to the marginless printing, a printing method that similarly limits the use of nozzles has also been proposed for maintaining an image quality at an area near the front end area of a print medium. The printing method, which limits the use of nozzles according to the position of an area of the print medium being printed as described above, is also necessary in an ordinary margined printing to maintain a good image quality. This method, however, has a problem that the nozzles that were kept out of use may produce an unstable ink ejection during their first scan immediately after they are allowed to be used, causing a possible image impairment, which in turn leads to an image quality degradation.

As described in Japanese Patent Application Laying-open Nos. 8-336962 (1996) and 10-016228 (1998), a method has been proposed which energizes heaters with such a short electric pulse as will not cause an ink ejection and thereby heats the ink in the nozzles to keep it at an elevated temperature. This method, however, is based on the assumption that an ordinary printing using all the nozzles in the nozzle column is to be performed, and is designed to prevent a temperature fall of the ink in the nozzles which may occur during a low duty printing or during a printing in a low temperature environment. This method does not consider the problem associated with the printing of the front end area of a print medium at all.

SUMMARY OF THE INVENTION

In light of the problem described above, the present invention has been accomplished to provide an ink jet printing apparatus which enables those nozzles that have been kept out of use in the preceding scans by a nozzle use limitation scheme to eject ink stably from the current scan in which they begin to be used for the first time. It is also an object of this invention to provide an ink jet printing method for performing such a control.

In one aspect, the present invention provides an ink jet printing apparatus for forming an image on a print medium by performing a printing operation and a transport operation, wherein the printing operation scans a print head over the print medium a plurality of times in a direction different from a nozzle array direction and ejects ink from the nozzles onto the print medium in each scan, the nozzle array direction being a direction in which a plurality of nozzles for ejecting ink are arrayed in the print head, wherein the transport operation moves, between the plurality of scans, the print medium a predetermined distance relative to the print head in a direction different from the scan direction of the print head, the ink jet printing apparatus comprising: a front end area printing means for printing on a front end area of the print medium by using only a part of the nozzles, the front end area ranging from a front end of the print medium to a predetermined position on the print medium; and an ejection readying means for making ready to perform ejection those nozzles that have not been used in preceding scans but begin to be used in a current scan after the print medium has been printed up to the predetermined position by the front end area printing means and when the printing is to be continued further following the predetermined position.

In another aspect, the present invention provides an ink jet printing method for forming an image on a print medium by performing a printing operation and a transport operation, wherein the printing operation scans a print head over the print medium a plurality of times in a direction different from a nozzle array direction and ejects ink from the nozzles onto the print medium in each scan, the nozzle array direction being a direction in which a plurality of nozzles for ejecting ink are arrayed in the print head, wherein the transport operation moves, between the plurality of scans, the print medium a predetermined distance relative to the print head in a direction different from the scan direction of the print head, the ink jet printing method comprising: a front end area printing step for printing on a front end area of the print medium by using only a contiguous part of the nozzles, the front end area ranging from a front end of the print medium to a predetermined position on the print medium; and an ejection readying step for making ready to perform ejection those nozzles that have not been used in preceding scans but begin to be used in a current scan after the print medium has been printed up to the predetermined position by the front end area printing step and when the printing is to be continued further following the predetermined position.

With the above configuration, after the front end area of the print medium has been printed and when the printing is to be continued following the front end area, those nozzles that have been kept out of use so far but begin to be used in the current scan are made ready to eject ink prior to the current scan so that they can eject ink stably from the current scan in which they begin to be used for the first time.

In still another aspect, the present invention provides an ink jet printing apparatus for forming an image on a print medium by performing a printing operation and a transport operation, wherein the printing operation scans a print head over the print medium a plurality of times in a direction different from a nozzle array direction and ejects ink from the nozzles onto the print medium in each scan, the nozzle array direction being a direction in which a plurality of nozzles for ejecting ink are arrayed in the print head, wherein the transport operation moves, between the plurality of scans, the print medium a predetermined distance relative to the print head in a direction different from the scan direction of the print head, the ink jet printing apparatus comprising: a preliminary ejection means for, when there are nozzles that have not been used in the preceding scans but begin to be used in the current scan, causing the nozzles to perform a preliminary ejection prior to the current scan in which the nozzles are used.

In a further aspect, the present invention provides an ink jet printing method for forming an image on a print medium by performing a printing operation and a transport operation, wherein the printing operation scans a print head over the print medium a plurality of times in a direction different from a nozzle array direction and ejects ink from the nozzles onto the print medium in each scan, the nozzle array direction being a direction in which a plurality of nozzles for ejecting ink are arrayed in the print head, wherein the transport operation moves, between the plurality of scans, the print medium a predetermined distance relative to the print head in a direction different from the scan direction of the print head, the ink jet printing method comprising: a preliminary ejection step for, when there are nozzles that have not been used in the preceding scans but begin to be used in the current scan, causing the nozzles to perform a preliminary ejection prior to the current scan in which the nozzles are used.

The above and other objects, effects, features and advantages of the present invention will become more apparent from the following description of embodiments thereof taken in conjunction with the accompanying drawings.

BRIEF DESCRIPTION OF THE DRAWINGS

FIG. 6 is a diagram showing nozzles used for each scan and nozzles requiring a preliminary ejection;

DETAILED DESCRIPTION OF PREFERRED EMBODIMENTS

Embodiments of the present invention will be described by referring to the accompanying drawings.

(Embodiment 1)

Figure 1:
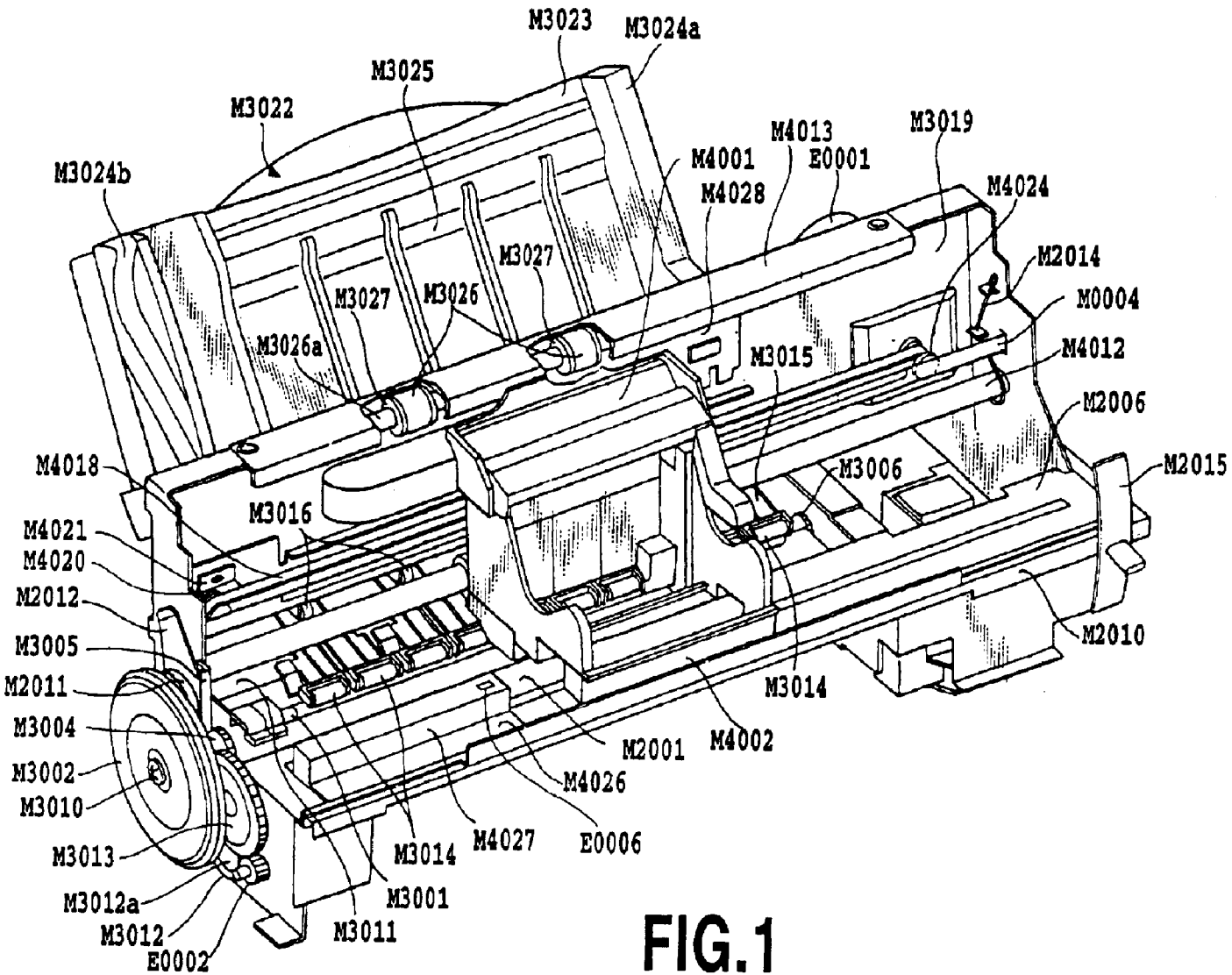
FIG. 1 is a cutaway perspective view showing an ink jet printing apparatus as one embodiment of the present invention.

FIG. 1 is a cutaway perspective view showing an ink jet printing apparatus of this embodiment.

Figure 2:
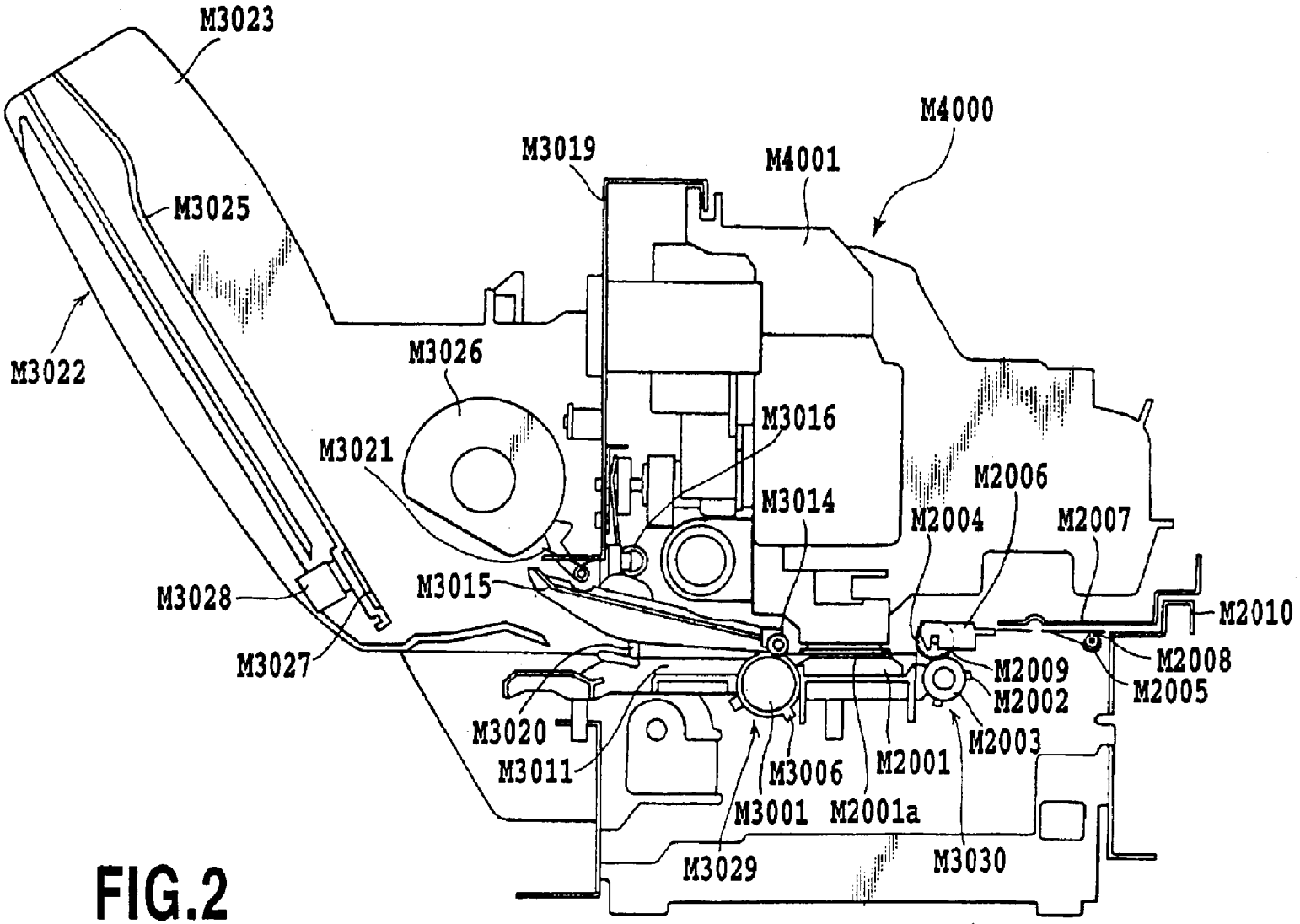
FIG. 2 is a cross-sectional view showing a transport system in the ink jet printing apparatus of FIG. 1.

FIG. 2 is a cross section showing a transport system in the ink jet printing apparatus of this embodiment.

Denoted M4001 is a carriage which is movably supported on a carriage shaft M4012. A print head not shown is detachably mounted on the carriage M4001.

Figure 3:
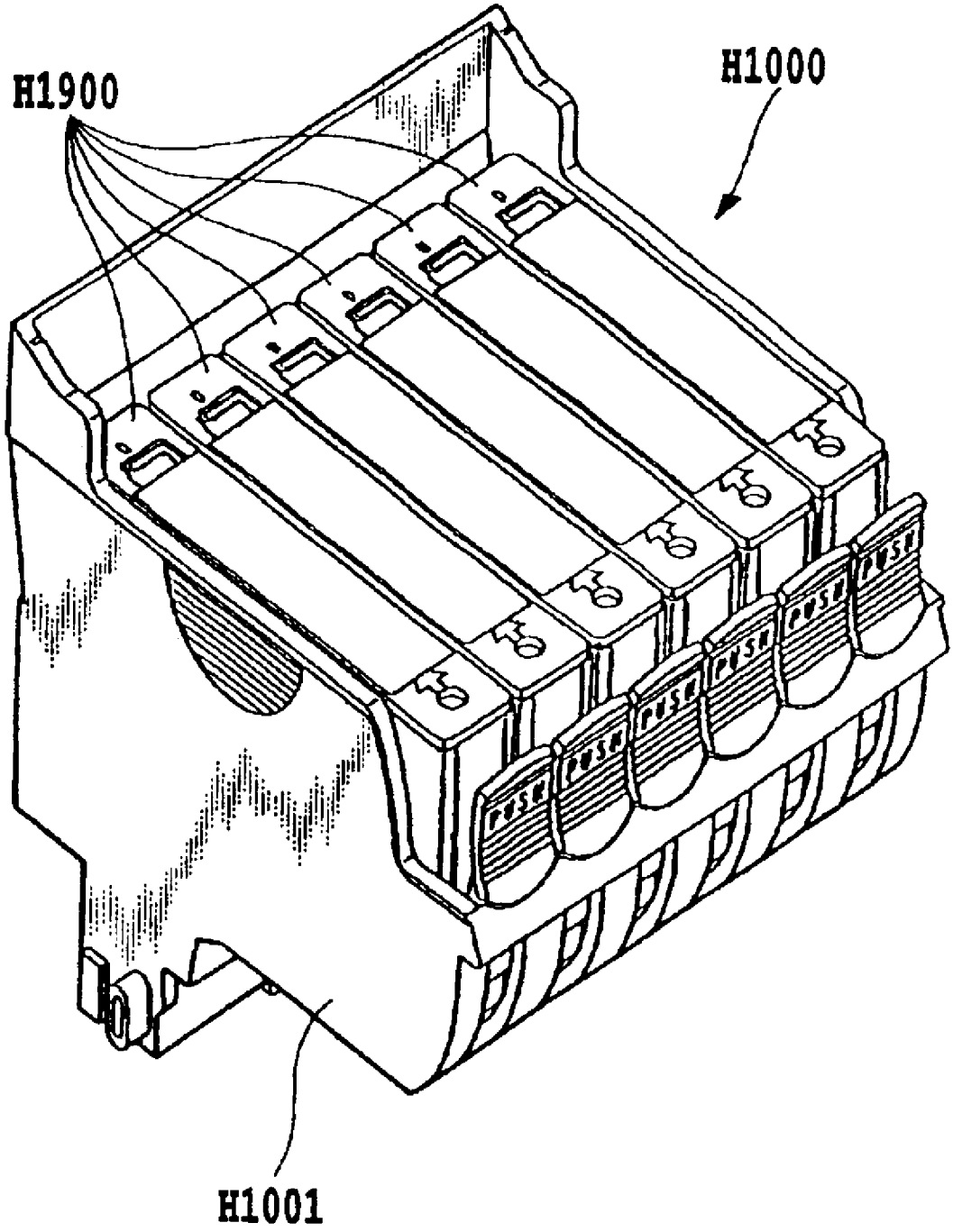
FIG. 3 is a perspective view showing a print head cartridge.

A print head cartridge H1000 in this embodiment has, as shown in FIG. 3, ink tanks H1900 containing inks and a print head H1001 for ejecting from its nozzles inks supplied from the ink tanks H1900. The print head H1001 is of a so-called cartridge type that is mounted on and dismounted from the carriage.

Designated M3025 is a paper supply tray to supply print media. In a printing operation, one of print medium sheets is transported by a first transport unit M3029 to a predetermined printing position. The printing position is where a nozzle opening surface of the print head mounted on the carriage faces the print medium. When the print medium is transported to the printing position, the print head ejects ink from its nozzles to perform printing as the carriage M4001mounting the print head moves from a print start position along the carriage shaft M4012. When the carriage M4001 reaches one side end of the print medium, a LF roller M3001 is rotated to feed the print medium a predetermined distance in a direction (hereinafter referred to as a "subscan direction") perpendicular to a carriage M4001 scan direction ("main scan direction"). By repetitively alternating the printing scan of the print head in the main scan direction and the line feed by the transport unit M3029 in the subscan direction as described above, an image is formed on the print medium. When the printing is completed, the discharge roller M2003 is rotated to move the printed medium in a discharge direction onto a discharge tray.

The print head has a plurality of nozzles arrayed in a predetermined direction for each ink color. The direction of nozzle arrays, when the print head is mounted on the carriage, is parallel to the sub-scan direction. A heater is provided for each nozzle and is energized to heat the ink in the nozzle near a nozzle opening to generate a bubble in the ink. An ink droplet of a predetermined volume is expelled from the nozzle by a pressure of the bubble as it grows. This printing technique employed in this embodiment is called a bubble-through system. Other ink jet printing methods may also be used.

Next, we will explain about a printing operation performed on a front end area of a print medium, about a printing operation on an area to be printed by using a group of nozzles including those that begin to be used in a current scan (also referred to as a transition area), and also about a printing operation performed on a normal area.

This embodiment assumes that each nozzle array in the print head has 512 nozzles. Where a high quality printed result is required as in the printing of photographic images, a multipass printing is done which performs printing a plurality of times on the same area of a print medium by using different nozzles. For example, in a 2-pass printing, a paper feed distance is equal to 256 nozzles (512÷2=256) and in a 4-pass printing it is equal to 128 nozzles (512÷4=128). Suppose a 4-pass printing is performed. In that case the nozzle column is divided into four blocks, each with 128 nozzles. In areas other than the front and rear end portions of a print medium, the same area is scanned four times by feeding the print medium a 128 nozzle distance to complete the printing operation. Areas other than the front and rear end portions are a normal area and a transition area or transition area. The normal area has no limitation on the use of nozzles and is printed using all 512 nozzles. The transition area is printed using a nozzle group including those nozzles that have been kept out of use up to the previous scan because of a nozzle use limitation but begin to be used in the current scan.

A printing operation on the front end area of a print medium uses only 128 nozzles counting from one end of the nozzle column and performs a very small line feed of about 32 nozzles. A whole printing process on one page beginning with the front end area and proceeding to the transition area and to the normal area will be described in detail.

Figure 4:
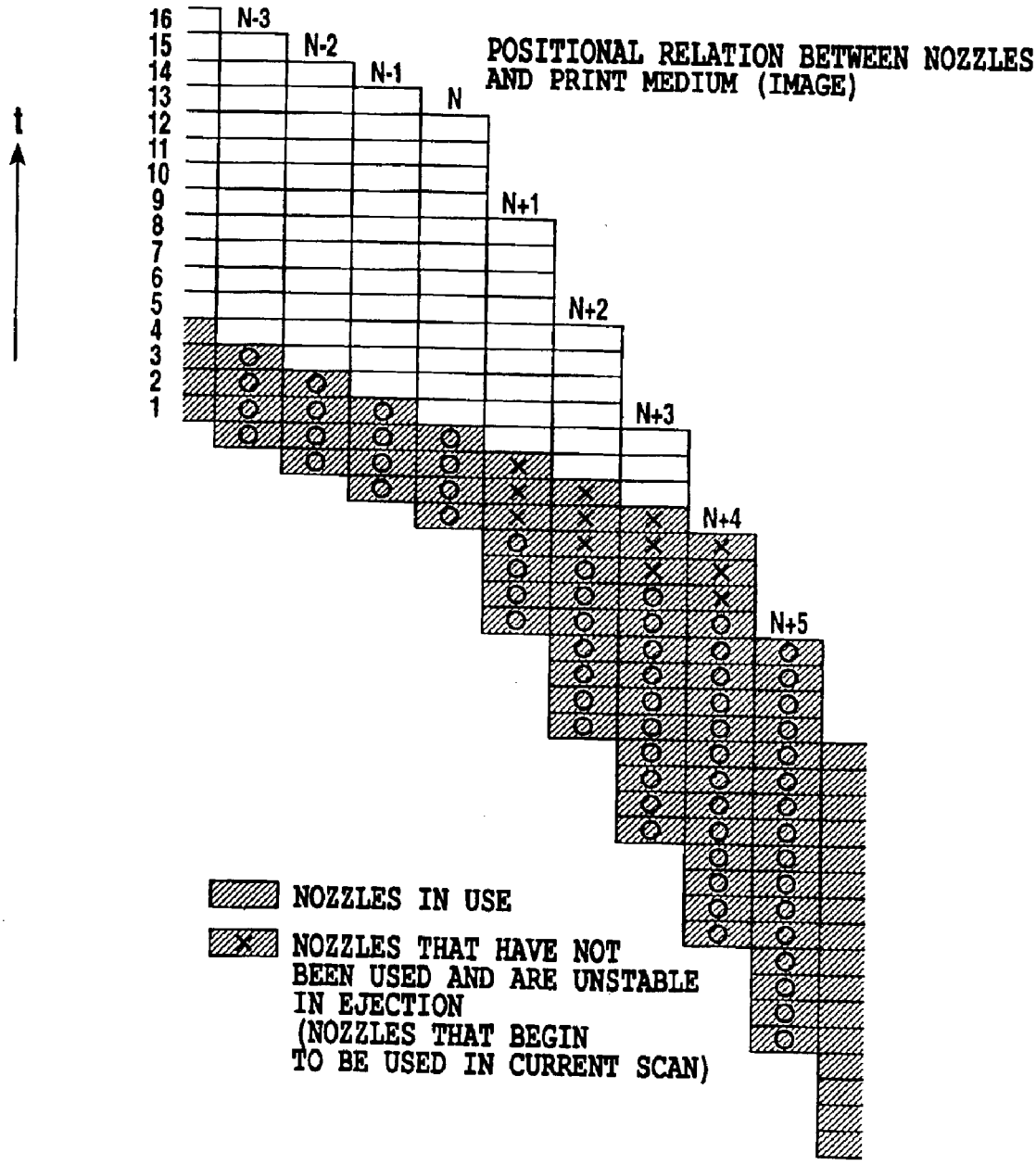
FIG. 4 is a schematic diagram showing relative positions of a nozzle column as it performs printing on a front end area of a print medium.

FIG. 4 is a schematic diagram showing relative positions of a nozzle column as it prints on a print medium from the front end area to the normal area. For easy understanding of the printing process on the front end area, this example uses a nozzle column with a reduced number of nozzles, 16 nozzles. In this example, a 4-pass printing is performed with a normal line feed set equal to 4 nozzles. In the printing operation on the front end area of a print medium, only four nozzles, counting from one end of the nozzle column, are used, putting the remaining nozzles out of use. A line feed distance during the front end area printing is set to about one nozzle, which is shorter than normal. The direction of paper feed or line feed is indicated by an arrow t. Nozzles in the nozzle column are numbered, from 1 to 16, in the ascending order from the rear end side with respect to the paper feed direction.

As shown in FIG. 4, in scans from (N−3) to (N), the front end area of a print medium is printed and only a part of the nozzle column of the print head is used, i.e., only four nozzles of nozzle No. 1–4 in FIG. 4. The line feed distance is as short as about one nozzle. Thus, for example, an area printed with dots ejected from a nozzle No. 1 in an (N−3)rd scan will be printed by nozzle number 2 in an (N−2)nd scan, by nozzle number 3 in an (N−1)st scan and by nozzle number 4 in an (N)th scan.

With the front end area printing completed at the (N)th scan, the transition area begins to be printed at an (N+1)st scan with a normal line feed distance. More specifically, starting from the (N+1)st scan, the line feed distance is increased to four nozzles. Therefore, nozzle No. 5 to 7 (marked with X), which have not been used up to the (N)th scan, are now used. At the (N+1)st scan, only the nozzles of No. 5–7 are subjected to the preliminary ejection prior to this scan. Next, at the (N+2)nd scan, since the nozzles of No. 8–10 were kept out of use in the preceding scans, these nozzles undergo the preliminary ejection prior to this scan. In this way, the preliminary ejection prior to the associated scan is continued until (N+4)th scan, at which time a nozzle of No. 16 begins to be used. That is, since in each of the (N+1)st to (N+4)th scan, there are nozzles which have been kept out of use in the preceding scans but begin to be used in the current scan, these nozzles are subjected to the preliminary ejection prior to the start of the associated scan to make them ready to perform ejection in good condition.

Figure 5:
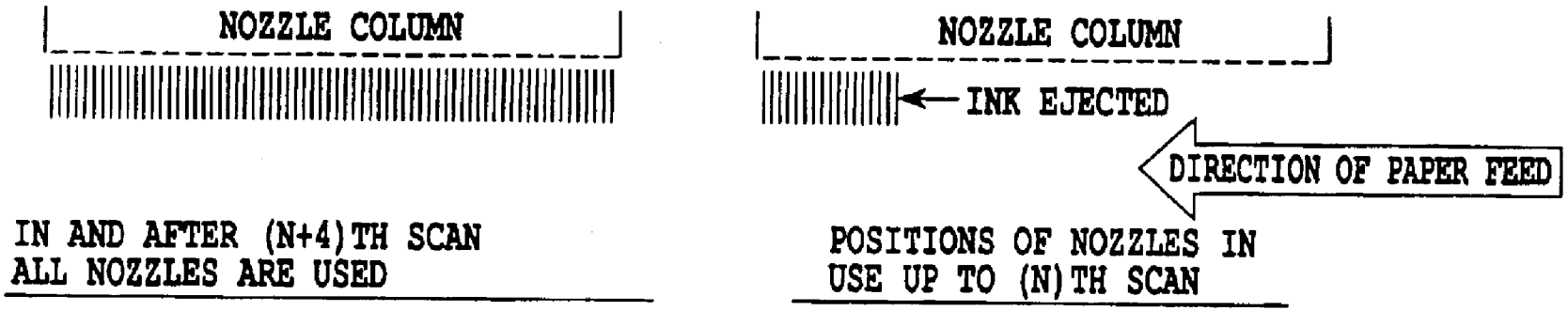
FIG. 5 is a schematic diagram showing nozzles used for printing at the front end area of a print medium and nozzles used for printing on an area following the front end area.

In and after (N+4)th scan, as shown in FIG. 5, all the nozzles are used for printing. If we take one box in FIG. 4 to contain 32 nozzles, this arrangement conforms to the case of a nozzle column of 512 nozzles. Further, since in and after the (N+5)th scan, the nozzles that were kept out of use in the preceding scans but begin to be used at the current scan no longer exist, the preliminary ejection operation is not performed. The normal area represents an area printed by those scans including and following the (N+5)th scan which have no limitation on the nozzle use and in which no special preliminary ejection operation as described above is executed.

Next, our explanation will be given to a control on the preliminary ejections performed prior to printing scans. The preliminary ejection is executed as the printing proceeds from the front end area to the transition area to a normal area in which printing is done with a normal printing width.

FIG. 6 shows a relation between nozzles used in each scan and nozzles requiring the preliminary ejection.

In 1st scan to (N)th scan the front end area of a print medium is printed; in (N+1)st scan to (N+4)th scan the transition area is printed with a normal line feed distance; and in and after (N+5)th scan the normal area is printed with a normal line feed distance by using all the nozzles. From starting the printing on the front end area up to the 4th scan, nozzles of No. 1–128 that are used for the front end area printing begin to be used successively 32 nozzles at a time. Hence, these nozzles are subjected to the preliminary ejection prior to each associated scan. From 5th scan to (N)th scan, all the nozzles of No. 1–128 are used and other nozzles are not used, so that no additional nozzles come into use in any of these scans. Thus, from 5th scan to (N)th scan, no preliminary ejection prior to the associated scan is executed. After this, from (N+1)st scan and afterwards, a normal line feed distance is used and the number of nozzles used increases. Nozzles that begin to be used at (N+1)st scan are No. 129–224 which are therefore subjected to the preliminary ejection. In this way the preliminary ejection continues to be performed on newly added nozzles, 96 nozzles at a time, up to (N+4)th scan at which time the last 96 nozzles of up to No. 512 begin to be used. In and after the (N+5)th scan, no additional nozzles enter into printing operation, so the preliminary ejection is no longer performed.

In the ink jet printing apparatus of this embodiment, a control unit for controlling various control units stores data in advance that indicates a relation between nozzles requiring the preliminary ejection and nozzles used for each scan, as shown in FIG. 6. The control unit controls various control units to execute the preliminary ejection and the printing operation according to a processing flow shown below.

Figure 7:
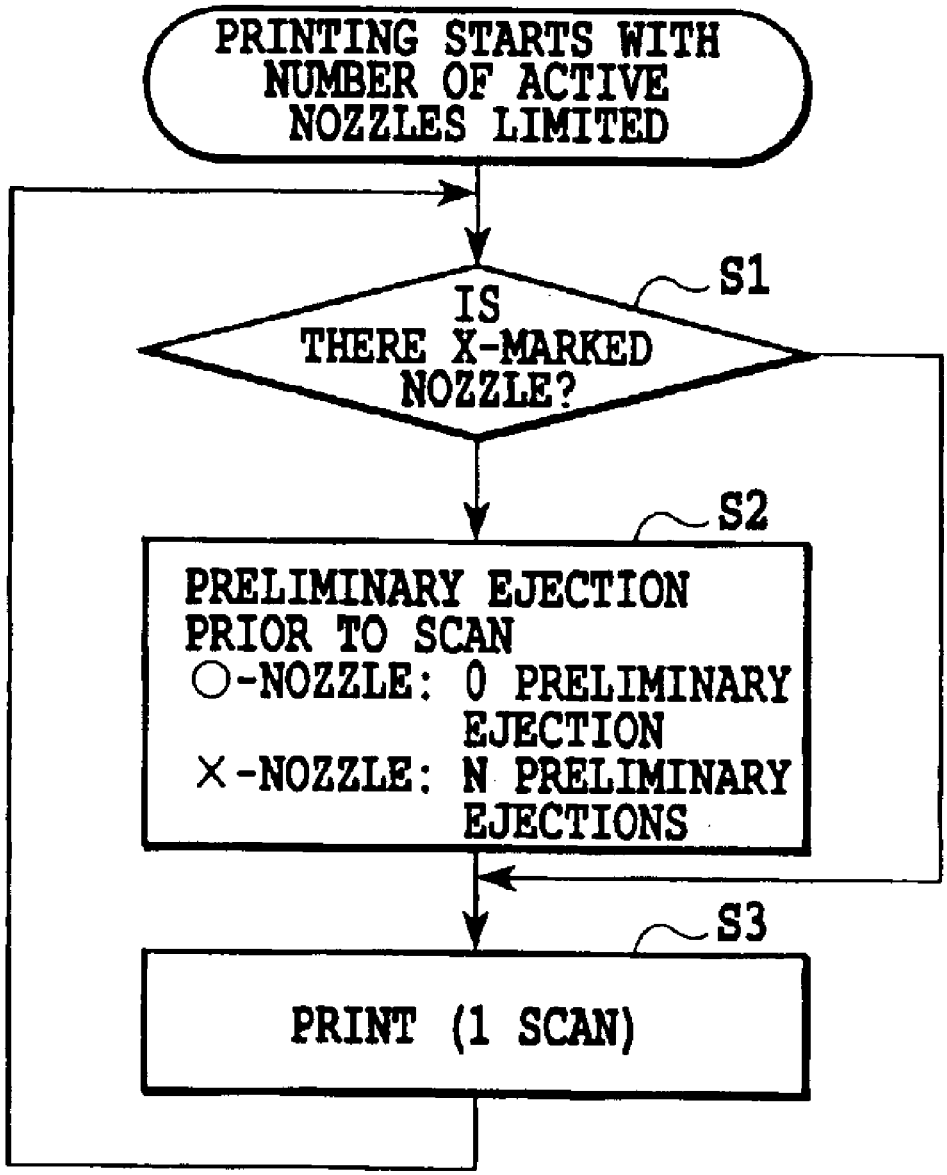
FIG. 7 is a flow chart showing a sequence of steps performed in making a decision on the preliminary ejection.

FIG. 7 is a flow chart showing a sequence of steps performed by preliminary ejection decision processing.

After receiving a printing operation start command from a host computer and before starting the printing operation, a check is made from the prestored data to see if the current scan has any nozzles requiring the preliminary ejection or those marked with X in FIG. 4 (step 1). When it is decided that there are nozzles requiring the preliminary ejection, the nozzles of interest are made to perform the preliminary ejection a required number of times (step 2). Then, after the preliminary ejection is done, the printing scan is performed (step 3). When, after the first scan is finished, the next scan is to be performed, the processing returns to step 1 to perform the similar actions. This sequence of operation is continued until the printing is completed.

As described above, only those nozzles that were not used in the preceding scans are subjected to the preliminary ejection immediately before the current scan in which they begin to be used. This preliminary ejection removes viscous ink from these nozzles to clean their interiors and make them ready for printing scan. This arrangement therefore can prevent faulty ejections, such as an ink ejection direction deviation and a failure to eject, thus assuring a satisfactory printed result.

While in this embodiment only those nozzles that are newly brought into use undergo the preliminary ejection just before the current scan in which they begin to be used, the present invention may employ other arrangements. For example, in a printing apparatus that performs the preliminary ejection on all the nozzles prior to every printing scan, only those nozzles that are newly activated for printing (nozzles marked with X in FIG. 4) may be given an increased ink ejection volume during the preliminary ejection to produce the similar effect.

Although the nozzles that undergo the preliminary ejection prior to each scan are predetermined based on the data of FIG. 6, this invention is not limited to this one pattern but may use an arrangement in which the number of nozzles removed from the printing operation can be set as variable data that is changed according to the kind of a print medium used and the printing method and in which the nozzles to be subjected to the preliminary ejection are also changed according to the change in the out-of-use nozzle data. Further, data on a relation between the nozzles used for printing scan and the nozzles used for preliminary ejection may be prepared and stored for each kind of print medium and for each printing method.

(Embodiment 2)

In Embodiment 1, only those nozzles which have been kept out of use so far in the preceding scans and begin to be used for the first time in the current scan are subjected to the preliminary ejection immediately before their printing operation. In this embodiment, a process of performing the preliminary ejection on the nozzles including those that have been in use so far will be explained. Only characteristic aspects of this embodiment will be described in the following.

As shown in FIG. 4, from (N+1)st scan to (N+4)th scan, there are nozzles that begin to be used in the associated scan (nozzles marked with X in the figure). In Embodiment 1, the preliminary ejection is performed only on these nozzles that begin to be used. However, this configuration requires processing of checking for the presence or absence of the nozzles that begin to be used, and therefore makes the preliminary ejection control complicated.

Hence, in this embodiment all the nozzles used in the current scan are subjected to the preliminary ejection immediately before the start of printing no matter when they come into use. More specifically, the following ejection control is executed.

FIG. 6 shows an association between scans and nozzles used in each scan. For example, (N+1)st scan uses nozzles of No. 1–224, (N+2)nd scan uses nozzles of No. 1–320, (N+3)rd scan uses nozzles of No. 1–416, and (N+4)th scan uses nozzles of No. 1–512.

In this embodiment, in the transition area where printing is performed using a nozzle group including those nozzles that have been kept out of use up to the previous scan but begin to be used in the current scan, the nozzles used in each scan—for example, No. 1–224 nozzle in the (N+1)st scan, No. 1–320 nozzle in the (N+2)nd scan, No. 1–416 nozzle in the (N+3)rd scan and No. 1–512 nozzle in the (N+4)th scan—are made to perform the preliminary ejection immediately before the start of the associated printing scan.

That is, not only the nozzles marked with X in FIG. 4 but the nozzles marked with O are also made to execute the preliminary ejection. Therefore, in the scans that have nozzles marked with X ((N+1)st scan to (N+4)th scan), the preliminary ejection is performed on both the nozzles marked with O and the nozzles marked with X before starting the associated printing scans. In the (N+1)st scan, for example, there are nozzles marked with X, so the preliminary ejection is performed on both the nozzles marked with O and the nozzles marked with X after the (N)th scan before the printing by the (N+1)st scan is started.

In the scans that have no nozzles marked with X, for example, (N)th scan and (N+5)th scan, because there are no additional nozzles that begin to be used in the current scan (nozzles marked with X), the preliminary ejection is not executed.

This configuration does not require step 1 and step 2 shown in FIG. 7, the step 1 checking for the presence or absence of the additional nozzles that begin to be used, the step 2 making only those additional nozzles perform the preliminary ejection. The only step required involves confirming the nozzles used for each scan and making all the nozzles used in the associated scan perform the preliminary ejection. Since all the nozzles used in the current scan are made to perform the preliminary ejection, the preliminary ejection control can be simplified and there is no need to store in memory in advance an association between the scan number and the newly activated nozzles. This in turn simplifies the structure of a data table to be stored beforehand which defines the relation between the scans and the nozzles. More specifically, the data table shown in FIG. 6 needs only to have a scan number column and an in-use nozzle column and does not need a newly activated nozzle (X-marked nozzle) column.

(Embodiment 3)

In Embodiment 1 and Embodiment 2, the preliminary ejection is performed if there are nozzles that begin to be used in the current scan (nozzles marked with X in FIG. 4). Either of the preceding embodiments requires a preliminary ejection operation control for each nozzle. Executing the preliminary ejection in units of nozzle complicates the control configuration. To simplify the preliminary ejection control, this embodiment performs the preliminary ejection operation on all the nozzles in the transition area.

That is, in the transition area in which printing is performed by using a nozzle group including those nozzles that have been kept out of use up to the previous scan but begin to be used in the current scan (nozzles marked with X in FIG. 4), all the nozzles are made to perform the preliminary ejection prior to each scan without regard to whether the nozzles are used in the associated scan.

(Embodiment 4)

In the above Embodiments 1 to 3, we have explained the preliminary ejection operation performed when there are nozzles that begin to be used in the current scan (hereinafter referred to as a "special preliminary ejection operation"). This embodiment uses not only this special preliminary ejection operation but also a timer preliminary ejection operation. How the special preliminary ejection operation and the timer preliminary ejection operation are used in combination will be described in the following. The construction of the apparatus and the arrangements of line feeds and nozzles in use are similar to those in Embodiment 1–3 and their explanations are omitted here.

As described above, in Embodiments 1 to 3, in a transition area where printing is performed by using a nozzle group including those nozzles which have not been used up to the previous scan but begin to be used in the current scan (nozzles marked with X in FIG. 4), the special preliminary ejection operation is executed prior to the printing by the current scan. In a normal area in which printing is done without using any additional nozzles that begin to be used in the current scan (nozzles marked with X in FIG. 4), the special preliminary ejection operation is not executed prior to the printing by the current scan. Thus, when the normal area is to be printed, some preliminary ejection operation other than the special preliminary ejection operation (for example, a timer preliminary ejection operation) needs to be performed. If no such preliminary ejection operation (e.g., timer preliminary ejection operation) is performed, an ink viscosity may rise in those nozzles that are not supplied with data, increasing a probability of clogged nozzles.

Thus this embodiment uses a timer preliminary ejection operation in combination with the special preliminary ejection operation. More specifically, the timer preliminary ejection operation involves measuring a time that elapses from the previous preliminary ejection operation and, when the measured time exceeds a predetermined time, executing the preliminary ejection operation.

With this arrangement, not only can ejection failures in the transition area be reduced, which is the feature of Embodiments 1 to 3, but it is also possible to reduce ejection failures in the normal area.

(Embodiment 5)

In the above Embodiments 1 to 4, an example case is taken up in which the printing on the transition area accompanied by the special preliminary ejection operation is preceded by the printing on a front end area that is not accompanied by the special preliminary ejection operation. Such a front end area, however, does not have to precede the transition area. That is, the transition area may be placed at the front end area of a print medium. In this configuration, it is obvious that the special preliminary ejection operation starts from the printing operation at the front end of the print medium.

(Embodiment 6)

In Embodiment 1, an example case has been described in which those nozzles that have not been used so far are made to perform the preliminary ejection immediately before they start printing. In Embodiment 2, explanation concerned an arrangement in which the preliminary ejection is performed on the nozzles that are to be used in the current scan. Further, in Embodiment 3, an arrangement has been explained in which the preliminary ejection is performed on all nozzles. In all these arrangements, however, since the preliminary ejection is performed before the nozzles are put into printing operation, ink not involved in printing is consumed by the preliminary ejection. Thus, to minimize a consumption of ink not used for printing, this embodiment applies such a level of heat to the nozzles not currently in use as will not cause an ink ejection, in order to keep the ink in these nozzles in an appropriate state for ejection.

In an ink jet printing apparatus of the similar construction to that of Embodiment 1, at the front end area of a print medium the nozzles used for printing are limited and the line feed distance is set very small, as shown in FIG. 4.

From (N+1)st scan the normal line feed distance is used. Those nozzles marked with X in the figure have not been used in the preceding scans and only begin to be used for the first time in (N+1)st scan. For those nozzles currently not in use for printing at the front end area, i.e., nozzles other than No. 1–128 nozzle (in FIG. 4, No. 5–16 nozzles), a short pulse that will not cause an ink ejection is applied successively to the heaters in these nozzles to keep the ink in the nozzles at almost the same elevated temperature as that of the nozzles currently in use (marked with O in FIG. 4).

Figure 8:
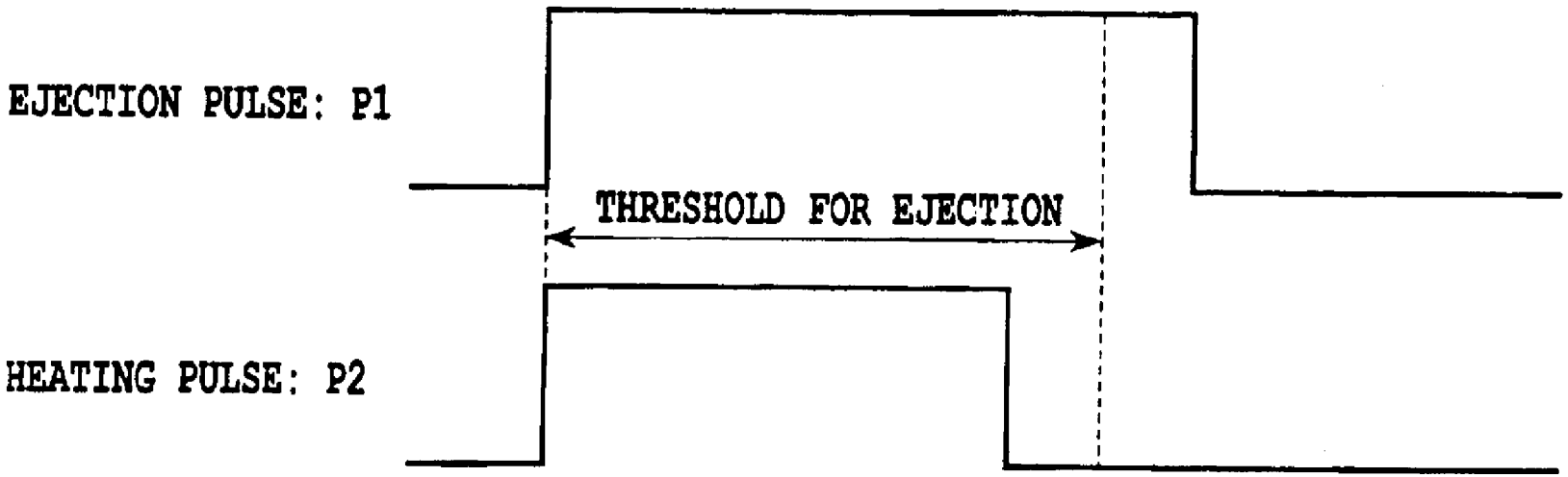
FIG. 8 illustrates a waveform of an ejection pulse and a waveform of a heating pulse.
Figure 9:
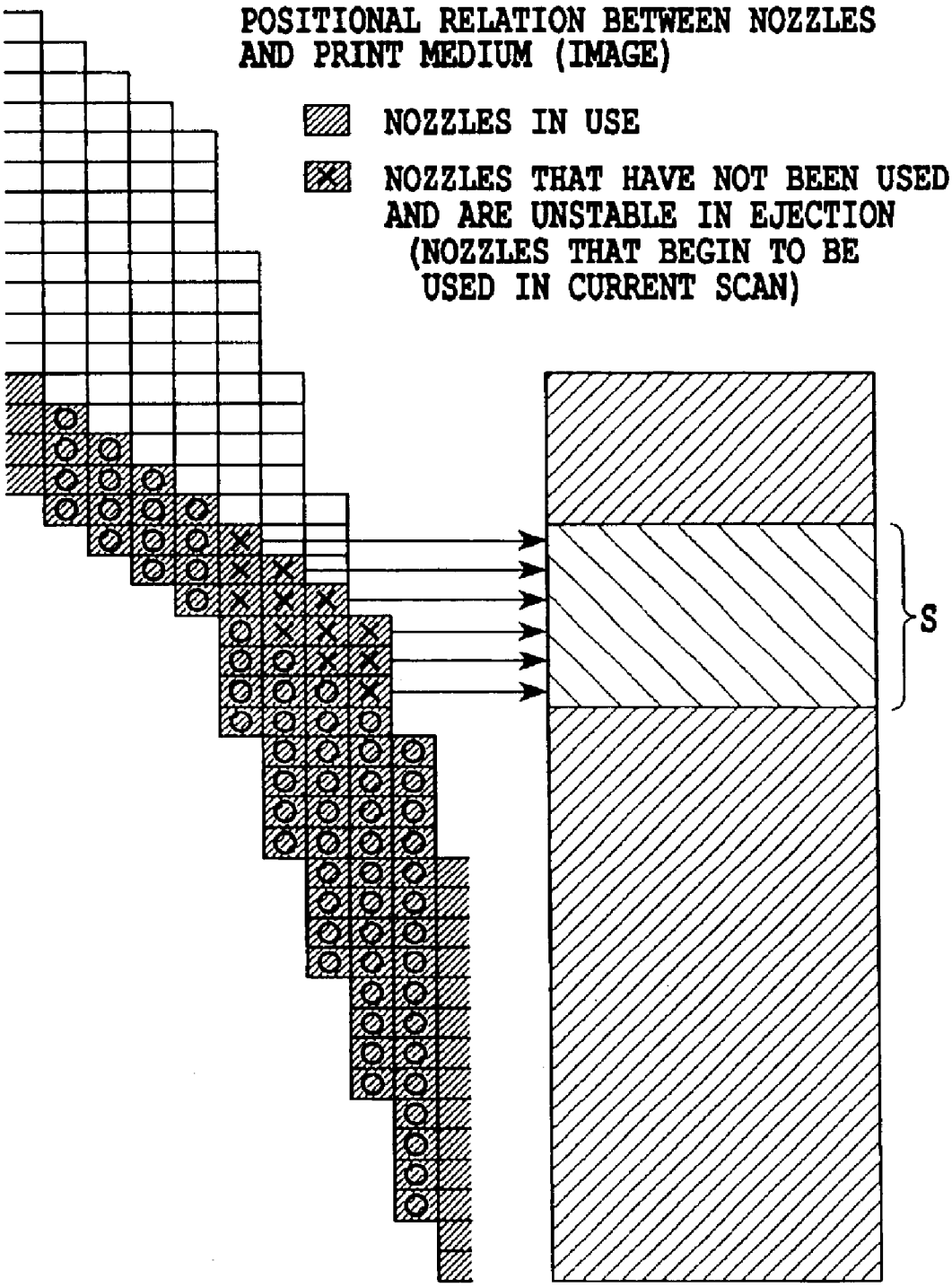
FIG. 9 is a schematic diagram showing relative positions of a nozzle column as it prints on a front end area of a print medium.

FIG. 8 shows a pulse used for ink ejection and a pulse used for heating.

A pulse P1 is one used to eject ink and is longer than a width indicated with a dotted line which is a minimum requirement to eject ink. The pulse P1 is sent to the nozzles marked with O in FIG. 4.

A pulse P2 is one used to heat ink to such an extent as will not cause an ink ejection. This pulse is set shorter than the minimum required width for ink ejection. Nozzles other than the O-marked nozzles in FIG. 4 are applied the pulse P2.

Referring to FIG. 4, in a scan immediately before the nozzles marked with X are used for printing, the X-marked nozzles are applied the pulse P2 and the O-marked nozzles are applied the pulse P1. For example, in (N)th scan the pulse P2 is sent to the X-marked nozzles of (N+1)st scan. This causes the ink in these nozzles which was at a low temperature to rise to a temperature where it is ready to be ejected. In the (N+1)st scan, because the X-marked nozzles which come into use in this scan were already heated well in the preceding scan, a good ink ejection can be performed.

The relation between the scans and the nozzles in use is pre-stored as data in the control unit, as in Embodiment 1, and the application of the pulse P2 is done based on this data. While in this embodiment the heating pulse is output one scan before the associated nozzles are operated for printing, this invention is not limited to this arrangement. The scan in which the heating pulse P2 is output may be any scan as long as it is before the associated nozzles begin to be operated.

As described above, when there are nozzles that begin to be used for the first time in the next scan, a heating pulse for heating ink to such an extent as will not cause an ink ejection is applied to these nozzles in the current scan to heat the ink in these nozzles to a temperature at which the ink is ready to be ejected. This ensures a good ink ejection when the nozzles of interest begin their operation in the next scan. Further, the above-described ejection control obviates the need to perform a preliminary ejection immediately before the printing, thus minimizing a consumption of ink. Furthermore, because a time spent performing the preliminary ejection is eliminated, the front end area can be printed in a shorter period of time.

In Embodiments 1 to 6, since the nozzles are rendered ejection-ready before they actually start operation, it is possible to prevent printed image disturbances which may otherwise occur as the printing proceeds from the front end area to the transition area to the normal area. Further, since those nozzles that have not been used so far but begin to be used during the transition from the front end area printing to the normal area printing are determined for each scan in which they begin to be operated and information on these nozzles is stored in advance, it is not required to analyze print data every time the data is received, as it was in Japanese Patent Application Laying-open No. 2001-239655, thereby simplifying the process routine.

The present invention achieves distinct effect when applied to a printing head or a printing apparatus which has means for generating thermal energy such as electrothermal transducers or laser light, and which causes changes in ink by the thermal energy so as to eject ink. This is because such a system can achieve a high density and high resolution printing.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet printing systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to printing information; second, the thermal energy induces sudden temperature rise that exceeds the nucleate boiling so as to cause the film boiling on heating portions of the printing head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better printing.

U.S. Pat. Nos. 4,558,333 and 4,459,600 disclose the following structure of a printing head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 59-123670(1984) and 59-138461 (1984) in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the printing head, the present invention can achieve printing positively and effectively.

In addition, the present invention can be applied to various serial type printing heads: a printing head fixed to the main assembly of a printing apparatus; a conveniently replaceable chip type printing head which, when loaded on the main assembly of a printing apparatus, is electrically connected to the main assembly, and is supplied with ink therefrom; and a cartridge type printing head integrally including an ink reservoir.

It is further preferable to add a recovery system, or a preliminary auxiliary system for a printing head as a constituent of the printing apparatus because they serve to make the effect of the present invention more reliable. Examples of the recovery system are a capping means and a cleaning means for the printing head, and a pressure or suction means for the printing head. Examples of the preliminary auxiliary system are a preliminary heating means utilizing electrothermal transducers or a combination of other heater elements and the electrothermal transducers, and a means for carrying out preliminary ejection of ink independently of the ejection for printing. These systems are effective for reliable printing.

The number and type of printing heads to be mounted on a printing apparatus can be also changed. For example, only one printing head corresponding to a single color ink, or a plurality of printing heads corresponding to a plurality of inks different in color or concentration can be used. In other words, the present invention can be effectively applied to an apparatus having at least one of the monochromatic, multi-color and full-color modes. Here, the monochromatic mode performs printing by using only one major color such as black. The multi-color mode carries out printing by using different color inks, and the full-color mode performs printing by color mixing.

Furthermore, although the above-described embodiments use liquid ink, inks that are liquid when the printing signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the printing medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the printing signal. In such cases, the ink may be retained in recesses or through holes formed in a porous sheet as liquid or solid substances so that the ink faces the electrothermal transducers as described in Japanese Patent Application Laying-open Nos. 54-56847 (1979) or 60-71260 (1985). The present invention is most effective when it uses the film boiling phenomenon to expel the ink.

Furthermore, the ink jet printing apparatus of the present invention can be employed not only as an image output terminal of an information processing device such as a computer, but also as an output device of a copying machine including a reader, and as an output device of a facsimile apparatus having a transmission and receiving function.

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

With this invention, the nozzles that have been kept out of use so far but begin to be used in the current printing scan are rendered ejection-ready. This can make the ejection operation of these nozzles satisfactory.

To make ejection-ready those nozzles that begin to be used in the current scan, the preliminary ejection may be performed on only these nozzles prior to the current scan. This sets the number of nozzles that perform the preliminary ejection to a minimum required and therefore can minimize an ink consumption by the preliminary ejection.

Further, in a transition area in which printing is performed using a nozzle group including those nozzles that have not been used in preceding scans but begin to be used in the current scan, the preliminary ejection may be performed prior to the current scan on all the nozzles that are to be used in the current scan or on all the nozzles of the print head. This simplifies the preliminary ejection control and minimizes the amount of data to be stored in advance.

Further, the nozzles that begin to be used in the next scan may in the current scan be applied heat of such an intensity as will not cause an ink ejection, in order to heat the ink in these nozzles. This method does not use the preliminary ejection and thus can minimize an ink consumption and also reduce the time it takes to complete the printing on the transition area.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An ink jet printing apparatus for forming an image on a print medium by performing a printing operation and a transport operation, wherein the printing operation scans a print head over the print medium a plurality of times in a direction different from a nozzle array direction and ejects ink from the nozzles onto the print medium in each scan, the nozzle array direction being a direction in which a plurality of nozzles for ejecting ink are arrayed in the print head, wherein the transport operation moves, between the plurality of scans, the print medium a predetermined distance relative to the print head in a direction different from the scan direction of the print head, the ink jet printing apparatus comprising:

a front end area printing means for printing on a front end area of the print medium by using only a part of the nozzles, the front end area ranging from a front end of the print medium to a predetermined position on the print medium; and an ejection readying means for making ready to perform ejection those nozzles that have not been used in preceding scans but begin to be used in a current scan after the print medium has been printed up to the predetermined position by the front end area printing means and when the printing is to be continued further following the predetermined position.

2. An ink jet printing apparatus according to claim 1, wherein the ejection readying means causes only those nozzles that have not been used in the preceding scans but begin to be used in the current scan to perform a preliminary ejection prior to the current scan.

3. An ink jet printing apparatus according to claim 1, wherein the ejection readying means causes those nozzles that are used in the current scan to perform a preliminary ejection prior to the current scan.

4. An ink jet printing apparatus according to claim 1, wherein the ejection readying means causes all the nozzles arrayed in the print head to perform a preliminary ejection prior to the current scan.

5. An ink jet printing apparatus according to claim 4, wherein the ejection readying means sets an ink ejection volume for only those nozzles that have not been used in the preceding scans but begin to be used in the current scan larger than an ink ejection volume for other nozzles.

6. An ink jet printing apparatus according to claim 1, wherein the print head generates a bubble in ink by a thermal energy produced by a thermal energy generation means provided in each liquid path communicating with the associated nozzle and ejects ink by a pressure of the bubble as it grows;

wherein the ejection readying means applies, prior to the current scan, the thermal energy of such an intensity as will not cause an ink ejection from the thermal energy generation means to the nozzles that have not been used in the preceding scans but begin to be used in the current scan.

7. An ink jet printing apparatus according to claim 6, wherein the ejection readying means generates the thermal energy by sending to the thermal energy generation means a pulse signal of such a width as will not cause an ink ejection.

8. An ink jet printing apparatus according to claim 1, wherein the print head generates a bubble in ink by a thermal energy produced by a thermal energy generation means provided in each liquid path communicating with the associated nozzle and ejects ink by a pressure of the bubble as it grows;

wherein the ejection readying means applies, in the current scan, the thermal energy of such an intensity as will not cause an ink ejection from the thermal energy generation means to the nozzles that are not used in the current scan but begin to be used in the next scan.

9. An ink jet printing apparatus according to claim 1, wherein the ejection readying means has data which predetermines, for each of the scans, the nozzles used in the current scan and the nozzles that have not been used in the preceding scans but begin to be used in the current scan and, during a printing operation, the ejection readying means makes desired nozzles ready to perform ejection according to the data.

10. An ink jet printing apparatus for forming an image on a print medium by performing a printing operation and a transport operation, wherein the printing operation scans a print head over the print medium a plurality of times in a direction different from a nozzle array direction and ejects ink from the nozzles onto the print medium in each scan, the nozzle array direction being a direction in which a plurality of nozzles for ejecting ink are arrayed in the print head, wherein the transport operation moves, between the plurality of scans, the print medium a predetermined distance relative to the print head in a direction different from a scan direction of the print head, the ink jet printing apparatus comprising:

a first printing means for performing the printing operation on a first area of the print medium by using a part of the nozzles of the print head;

a second printing means for performing the printing operation on a second area of the print medium by using all the nozzles of the print head;

a third printing means for performing the printing operation on a third area between the first and second areas;

a judging means for judging whether there are nozzles that have not been used in preceding scans but begin to be used in a current scan in the printing operation for the third area; and a preliminary ejection means for causing the nozzles to perform a preliminary ejection, wherein, when said judging means judges that there are nozzles that have not been used in the preceding scans but begin to be used in the current scan, said preliminary ejection means causes those nozzles which begin to be used in the current scan, to perform the preliminary ejection prior to the printing operation on the third area.

11. An ink jet printing apparatus according to claim 10, wherein, when there are no nozzles that have not been used in the preceding scans but begin to be used in the current scan, said preliminary ejection means does not cause the preliminary ejection to be performed prior to the current scan.

12. An ink jet printing method for forming an image on a print medium by performing a printing operation and a transport operation, wherein the printing operation scans a print head over the print medium a plurality of times in a direction different from a nozzle array direction and ejects ink from the nozzles onto the print medium in each scan, the nozzle array direction being a direction in which a plurality of nozzles for ejecting ink are arrayed in the print head, wherein the transport operation moves, between the plurality of scans, the print medium a predetermined distance relative to the print head in a direction different from the scan direction of the print head, the ink jet printing method comprising:

a front end area printing step, of printing on a front end area of the print medium by using only a part of the nozzles, the front end area ranging from a front end of the print medium to a predetermined position on the print medium; and an ejection readying step, of making ready to perform ejection those nozzles that have not been used in preceding scans but begin to be used in a current scan after the print medium has been printed up to the predetermined position by said front end area printing step and when the printing is to be continued further following the predetermined position.

13. An ink jet printing method according to claim 12, wherein said ejection readying step includes causing those nozzles that have not been used in the preceding scans but begin to be used in the current scan to perform a preliminary ejection prior to the current scan.

14. An ink jet printing method according to claim 12, wherein said ejection readying step includes causing those nozzles that are used in the current scan to perform a preliminary ejection prior to the current scan.

15. An ink jet printing method according to claim 12, wherein said ejection readying step includes causing all the nozzles arrayed in the print head to perform a preliminary ejection prior to the current scan.

16. An ink jet printing method according to claim 15, wherein said ejection readying step includes setting an ink ejection volume for only those nozzles that have not been used in the preceding scans but begin to be used in the current scan larger than an ink ejection volume for other nozzles.

17. An ink jet printing method according to claim 12, wherein said ejection readying step includes setting an ink temperature in those nozzles that have not been used in the preceding scans but begin to be used in the current scan to a temperature at which the ink is ready to be ejected.

18. An ink jet printing method according to claim 17, wherein said ejection readying step includes applying a thermal energy of such an intensity as will not cause an ink ejection to the nozzles that have not been used in the preceding scans but begin to be used in the current scan to heat the ink in the nozzles to a temperature at which the ink is ready to be ejected.

19. An ink jet printing method for forming an image on a print medium by performing a printing operation and a transport operation, wherein the printing operation scans a print head over the print medium a plurality of times in a direction different from a nozzle array direction and ejects ink from the nozzles onto the print medium in each scan, the nozzle array direction being a direction in which a plurality of nozzles for ejecting ink are arrayed in the print head, wherein the transport operation moves, between the plurality of scans, the print medium a predetermined distance relative to the print head in a direction different from a scan direction of the print head, the ink jet printing method comprising:

a first printing step for performing the printing operation on a first area of the print medium by using a part of the nozzles of the print head;

a second printing step for performing the printing operation on a second area of the print medium by using all the nozzles of the print head;

a third printing step for performing the printing operation on a third area between the first and second areas;

a judging step for judging whether there are nozzles that have not been used in preceding scans but begin to be used in a current scan in the printing operation for the third area; and a preliminary ejection step for causing the nozzles to perform a preliminary ejection, wherein, when it is judged in said judging step that there are nozzles that have not been used in the preceding scans but begin to be used in the current scan, the nozzles, which begin to be used in the current scan, said preliminary rejection step is performed to cause the preliminary ejection prior to the printing operation on the third area.

20. An ink jet printing method according to claim 19, wherein, when there are no nozzles that have not been used in the preceding scans but begin to be used in the current scan, said preliminary ejection step is not performed to cause preliminary ejection to be performed prior to the current scan.

* * * * *